US006729521B1

(12) United States Patent
Strine

(10) Patent No.: US 6,729,521 B1
(45) Date of Patent: May 4, 2004

(54) POCKET MEMO PAD HOLDER CONSTRUCTION

(76) Inventor: Jon Jesse Strine, 3 Park View Rd., Elysburg, PA (US) 17824

( * ) Notice: Subject to any disclaimer, the term of this patent is extended or adjusted under 35 U.S.C. 154(b) by 102 days.

(21) Appl. No.: 10/198,308

(22) Filed: Jul. 18, 2002

(51) Int. Cl.[7] ..... A45F 5/00

(52) U.S. Cl. ..... 224/674; 224/241; 224/245; 224/677; 224/679

(58) Field of Search ..... 224/199, 241, 224/245, 246, 671, 674, 677, 678, 679, 680; 206/38, 38.1, 216, 232; 24/3.6, 3.7, 3.12, 570

(56) References Cited

U.S. PATENT DOCUMENTS

| | | | | | |
|---|---|---|---|---|---|
| 1,314,392 | A | * | 8/1919 | Glamzo | 224/679 |
| 1,408,589 | A | * | 3/1922 | Hachmann | 24/3.12 |
| 1,487,433 | A | * | 3/1924 | Beckert | 224/241 |
| 1,648,565 | A | * | 11/1927 | Primley | 224/674 |
| 1,672,766 | A | * | 6/1928 | March | 206/38 |
| 1,679,588 | A | * | 8/1928 | Spraul | 24/3.6 |
| 2,191,680 | A | * | 2/1940 | Petishman | 206/38 |
| 2,850,220 | A | * | 9/1958 | Freeman et al. | 224/245 |
| 3,279,009 | A | * | 10/1966 | Teasdale | 24/3.12 |
| D256,375 | S | | 8/1980 | Llanos | D19/75 |
| 4,342,350 | A | | 8/1982 | Resnick | 150/35 |
| 5,427,254 | A | | 6/1995 | Knieriem | 211/50 |
| 5,511,390 | A | * | 4/1996 | Mah | 206/38.1 |
| D379,830 | S | | 6/1997 | Wasylyk | D19/90 |
| 5,706,935 | A | * | 1/1998 | Lorton | 206/38 |
| 6,530,509 | B1 | * | 3/2003 | Davis | 224/219 |
| 6,651,854 | B1 | * | 11/2003 | LaCoste | 224/199 |

* cited by examiner

*Primary Examiner*—Gary E. Elkins
(74) *Attorney, Agent, or Firm*—Sturm & Fix LLP

(57) ABSTRACT

A pocket sized memo pad holder construction 10 adapted to be selectively attached to a key ring 50 or a user's belt 60 wherein, the construction 10 includes a generally rigid housing member 20 having a curved upper housing segment 24 provided with a holder element 27 for a writing implement 200 and hingedly connected to a lower housing segment 21 provided with a catch element 28 that is connected to a clip member 30 that may selectively receive the key ring 50 or the user's belt.

12 Claims, 1 Drawing Sheet

POCKET MEMO PAD HOLDER CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of memo pad receiving constructions in general and in particular to a hard cased memo pad holder that is adapted to be connected to a key chain or to an article of clothing worn by the user.

2. Description of Related Art

As can be seen by reference to the following U.S. Pat. Nos. 4,342,350; 5,427,254; DES. 379,380; and, Des. 256, 375, the prior art is replete with myriad and diverse memo pad holding devices.

While all of the aforementioned prior art constructions are more than adequate for the basic purpose and function for which they have been specifically designed, they are uniformly deficient with respect to their failure to provide a simple, efficient, and practical pocket sized memo pad holder construction which totally encloses the memo pad when not in use and which is adapted to be connected to a key chain or directly to an article of clothing worn by the user.

As anyone who needs to make notes on a regular basis is all too well aware, most prior art memo pad holder constructions are either too bulky, do not provide adequate protection to the memo sheets, or serve only a limited specific purpose.

As a consequence of the foregoing situation, there has existed a longstanding need for a new and improved pocket sized memo pad holder construction that avoids all of the shortcomings of the prior art constructions while also performing other diverse useful functions; and the provision of such a construction is a stated objective of the present invention.

BRIEF SUMMARY OF THE INVENTION

Briefly stated, the pocket memo pad holder construction that forms the basis of the present invention comprises in general a housing unit and a clip unit associated with the housing unit and adapted to be connected to a key ring or to threadedly receive a user's belt or purse strap.

As will be explained in greater detail further on in the specification, the housing unit includes a hard sided housing member including a lower housing segment hingedly connected to an upper housing segment having a curved roof wherein the lower housing segment is dimensioned to receive a memo pad and the interior of the curved roof of the upper housing segment is provided with means for releasably receiving a conventional writing implement.

In addition, one of the sidewalls on the lower housing segment is provided with a catch element that is adapted to pass through the clip unit which includes an elongated clip member having a pair of enlarged eyelets disposed on the opposite ends of an elongated narrow intermediate portion wherein the clip member may be attached to a key ring, a user's belt or a purse strap as desired.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
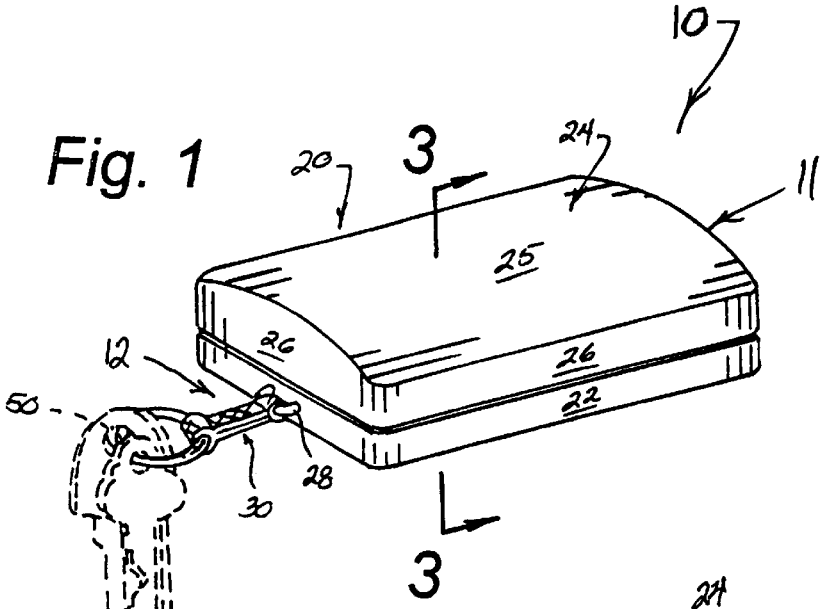
FIG. 1 is a perspective view of the memo pad holder construction in the closed position.

As can be seen by reference to the drawings, and in particularly to FIG. 1, the pocket sized memo pad holder construction that forms the basis of the present invention is designated generally by the reference number 10. The construction 10 comprises in general a housing unit 11 and a clip unit 12. These units will now be described in seriatim fashion.

Figure 2:
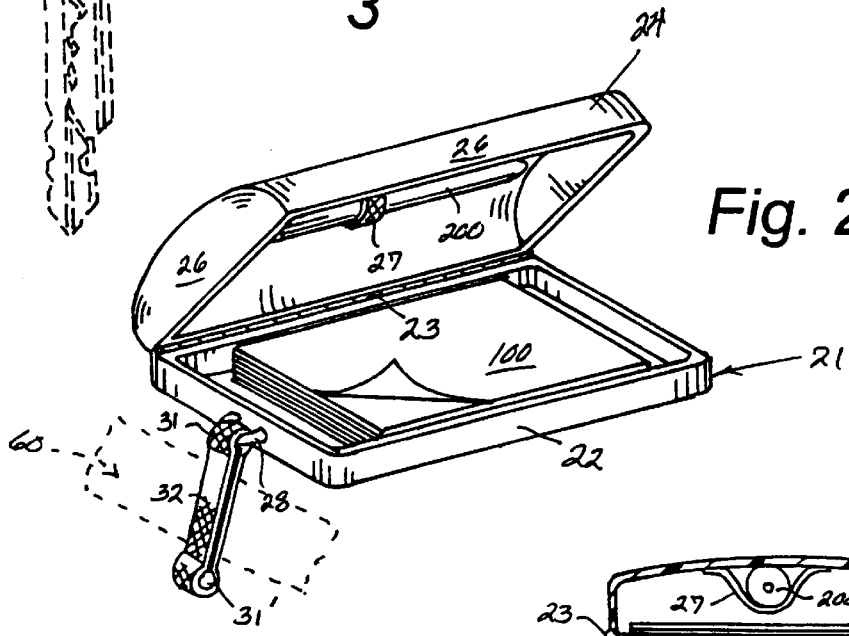
FIG. 2 is a perspective view of the memo pad holder construction in the partially open position.
Figure 3:
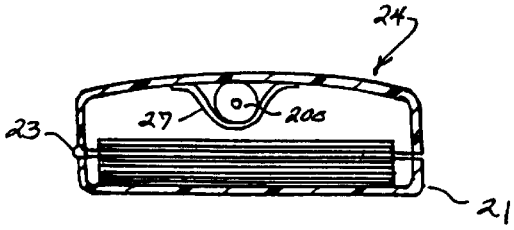
FIG. 3 is a cross-sectional view taken through line 3—3 of FIG. 1; and, FIG. 4 is a front elevation view of the memo pad holder construction in the fully open position.
Figure 4:
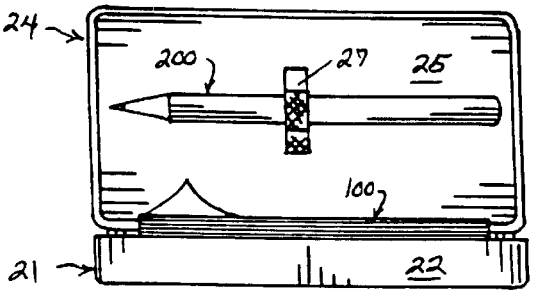

As shown in FIGS. 2 through 4, the housing unit 11 comprises a generally rigid housing member 20 having a generally flat rectangular lower housing segment 21 provided with raised sidewalls 22 and dimensioned to receive a memo pad 100 which is hingedly connected as at 23 to an upper housing segment 24 having a curved roof portion 25 provided with downwardly depending sidewalls 26.

In addition, the underside of the curved roof portion of the upper housing segment 24 is provided with a holder element 27 for releasably securing a writing implement 200 such as a pen or pencil in the interior of the hard sided housing member 20.

Furthermore, as can best be seen by reference to FIGS. 1 and 2, the generally rigid housing member 20 further includes a catch element 28 projecting outwardly from one of the sidewalls 22 of the lower housing segment 21 for reasons that will be explained presently.

Still referring to FIGS. 1 and 2, it can be seen that the clip unit 12 comprises an elongated clip member 30 having enlarged eyelets 31 31' formed on the opposite ends of a generally elongated narrow intermediate portion 32; wherein, one of the eyelets 31 is adapted to engage the catch element 28 on the housing member 20 and the other eyelet 31' is adapted to engage a key ring 50 or the like; and, wherein the intermediate portion 32 of the clip member is dimensioned to threadedly receive a portion of a user's belt 60 belt strap or purse strap (not shown) depending upon whether the user wishes to store the holder construction 10 in their pocket or connected to an article of clothing or accessory item based on the frequency of access to the memo pad 100 and writing implement 200 that the user normally encounters.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A memo pad holder construction adapted to be selectively attached to a key ring, a user's belt or a purse strap wherein the construction comprises;

a housing unit including a generally rigid housing member having an upper housing segment hingedly connected to a lower housing segment provided with a catch element; and, a clip unit including a generally elongated clip member having an elongated narrow intermediate portion whose opposite ends terminate in a pair of enlarged eyelets wherein at least one of the eyelets is adapted to be operatively engaged with said catch element on the lower housing segment of the housing member.

2. The construction as in claim 1; wherein, the upper segment of the housing member has a curved roof.

3. The construction as in claim 1; wherein, the upper segment of the housing member is provided with means for releasably engaging a writing implement.

4. The construction as in claim 2; wherein, the upper segment of the housing member is provided with means for releasably engaging a writing implement.

5. The construction as in claim 1; wherein, the elongated narrow intermediate portion of the clip member is adapted to selectively receive a user's belt, belt strap or a purse strap.

6. The construction as in claim 5; wherein, the upper segment of the housing member has a curved roof.

7. The construction as in claim 5; wherein, the upper segment of the housing member is provided with means for releasably engaging a writing implement.

8. The construction as in claim 1; wherein, the lower housing segment has raised sidewalls, a generally rectangular configuration and is dimensioned to receive a memo pad.

9. The construction as in claim 8; wherein, the upper housing segment has a curved roof and downwardly depending sidewalls.

10. The construction as in claim 8; wherein, the upper segment of the housing member is provided with means for releasably engaging a writing implement.

11. The construction as in claim 1; wherein, at least one of the enlarged eyelets is dimensioned to releasably receive a key ring.

12. The construction as in claim 11; wherein, the elongated narrow intermediate portion of the clip member is adapted to selectively receive a user's belt, belt strap or a purse strap.

* * * * *